US005480119A

United States Patent [19]

Fish et al.

[11] Patent Number: 5,480,119

[45] Date of Patent: Jan. 2, 1996

[54] PORTABLE PODIUM

[75] Inventors: James S. Fish, Plymouth; Dennis Deutsch, Hastings, both of Minn.

[73] Assignee: Pierce Companies, Inc., Santa Ana, Calif.

[21] Appl. No.: 241,609

[22] Filed: May 11, 1994

[51] Int. Cl.[6] ..... A47B 97/04

[52] U.S. Cl. ..... 248/460; 248/464; 108/127

[58] Field of Search ..... 248/460, 461, 248/464, 167; 312/314, 316; 108/35, 115, 127, 129

[56] References Cited

U.S. PATENT DOCUMENTS

| | | | |
|---|---|---|---|
| D. 306,535 | 3/1990 | Evenson | D6/419 |
| D. 320,319 | 10/1991 | Brothers et al. | D6/419 |
| 2,054,098 | 9/1936 | Ricit | 248/464 |
| 2,598,128 | 5/1952 | Liechty | 108/35 |
| 2,808,304 | 10/1957 | Smith | 248/464 |
| 2,844,347 | 7/1958 | Henry | 248/198 |
| 2,893,808 | 7/1959 | Waterman | 312/316 |
| 3,056,230 | 10/1962 | Brokaw, Jr. | 45/121 |
| 3,073,057 | 1/1963 | Farber | 248/461 |
| 3,271,075 | 9/1966 | Good | 108/129 |
| 3,365,072 | 1/1968 | Hill | 248/464 |
| 3,424,283 | 1/1969 | Sheldon | 248/461 |
| 3,652,051 | 3/1972 | McFarlane | 248/444 |
| 3,848,944 | 11/1974 | Gilmer, Jr. | 312/314 |
| 3,861,328 | 1/1975 | Lawless | 108/115 |
| 4,258,833 | 3/1981 | Simms | 190/11 |
| 4,484,787 | 11/1984 | Stephens | 312/239 |
| 4,607,817 | 8/1986 | Aquino | 248/459 |
| 4,623,276 | 11/1986 | Kinneir | 402/80 R |
| 4,660,904 | 4/1987 | Stephens | 312/140.2 |
| 5,044,595 | 9/1991 | Carr et al. | 248/460 |
| 5,152,491 | 10/1992 | Forster et al. | 248/454 |

FOREIGN PATENT DOCUMENTS

| | | | |
|---|---|---|---|
| 1252489 | 6/1969 | United Kingdom | 248/460 |

*Primary Examiner*—Leslie A. Braun
*Assistant Examiner*—Anita M. King
*Attorney, Agent, or Firm*—Price, Gess & Ubell

[57] ABSTRACT

A lightweight portable podium is provided for use in lectures and other speaking events. The podium rests on a table or desk and has an inclined shelf which forms the upper surface on which notes and papers can readily repose. The shelf is screened from public view and protected from wind by a main panel that forms the front of the podium and two side panels. The four pieces that comprise the podium are substantially flat and can be readily disassembled into a flat unit for storage or transit. The upper edge of the shelf is captured by two channels formed between the main and side panels. For disassembly the shelf is first pivoted to be parallel to the main panel. It is then slidden in the channels in a downward direction into contact with the main panel. The two side panels are then folded in over the shelf/main panel combination to form a flat, thin unit for storage or transit.

14 Claims, 3 Drawing Sheets

PORTABLE PODIUM

BACKGROUND OF THE INVENTION

1. Field of the Invention

The present invention relates generally to lecterns or podiums for the support of books or papers for reference by a lecturer or speaker and, more specifically, to such a device that can readily be collapsed and folded into a compact, flat, lightweight package for ready transport.

2. Description of Related Art

A typical podium or lectern provides a means for holding a speaker's notes and papers. Generally, the podium sits on a table in front of the speaker and has a slanted top surface which holds papers on a level higher than the table so that the speaker can easily read his or her notes by glancing slightly downward. U.S. Pat. No. Des. 320,319 to Brothers et al. shows the typical features of a podium with an inclined upper surface to hold notes and papers at a convenient angle. Although this design is attractive and functional, it suffers from a lack of portability. Even a small podium is rather ungainly. It is difficult to move it from room to room, let alone from building to building. A podium also takes up considerable space when not in use. Furthermore, a speaker may have to bring his or her own podium on speaking trips. This requires a readily collapsible podium that can fold into a small enough package to form part of the speaker's carry-on airline baggage.

There have been numerous efforts to produce a podium or lectern that can be readily broken down for storage or transit and then quickly assembled for use. U.S. Pat. No. Des. 306,535 to Evenson shows the basic form of a "Foldable Lectern." An inclined surface is provided to hold notes or papers and, in addition, some side screening is provided to prevent wind from disturbing the notes. However, the folding mechanism is not taught in the design patent.

U.S. Pat. No. 4,484,787 to Stephens also teaches a foldable voting booth/lectern. The booth has long lateral walls that act as legs so that the device sits directly on the floor rather than on a table. Also, while this lectern provides a screened area to hold the speaker's notes, there is no provision to maintain the notes at a convenient angle for ease of reading. Although the unit can be disassembled, the size of the lateral walls makes the components a bit too large for ready transport.

Another podium tall enough to stand on the floor is disclosed by U.S. Pat. No. 3,861,328 to Lawless. When collapsed, the device forms a convenient carrying case for transport. The podium is composed of a horizontal base and an upper, substantially horizontally-disposed paper-supporting plate. These two components are connected by accordion-style foldable links that are capable of engaging and locking with one another to hold the paper-supporting plate in a standing position. However, this device does not provide a wind screen for the papers, nor does it act as a shield to partially conceal the speaker.

U.S. Pat. No. 2,844,347 to Henry teaches a collapsible podium with an elevated and inclined surface for notes. The device folds into a flat package for ease of transportation. The device is of fairly complex construction and, while it does partially conceal the speaker, it fails to provide a screened area for protecting the speaker's notes.

U.S. Pat. No. 3,056,230 to Brokaw provides a portable podium of relatively simple structure of four main parts that folds into a flat package for storage. The device provides an inclined surface that is significantly elevated from the surface of a table or other like object. Thus, a structure is provided which gives partial concealment to a speaker standing behind it. However, the inclined surface is on the top of the device and is, therefore, not screened from wind or audience view.

OBJECTS AND SUMMARY OF THE INVENTION

It is an object of the present invention to provide a portable podium that is light in weight and compact when collapsed;

It is a further object of the present invention to provide a portable podium that, when assembled, has an inclined surface for the speaker's notes;

It is also an object of the present invention to provide a portable podium that, when assembled, yields a structure behind which a speaker can stand and which protects the speaker's notes from wind; and It is another object of the present invention to provide a portable podium that is simple to manufacture and easy to assemble.

These and other related objects are realized by a portable podium that it constructed from three substantially flat panels of lightweight material. The assembled podium is designed to sit on a supporting surface such as a table or desk. A main panel is oriented perpendicular to the supporting surface and parallel to the speaker's chest so that the main panel forms a screen that partially conceals a standing speaker. The main panel, which faces the audience, is supported by two side panels which are attached at right angles to either end of the main panel to form a rectangular structure with three solid sides and an open side facing the speaker. The speaker's notes are supported by a fourth panel, a shelf, that is slantingly supported by the other three panels to form an upper surface of the rectangular structure. The shelf is recessed below upper edges of the main and side panels so that those panels form a windscreen and also shield the papers from the view of the audience.

The podium can be readily disassembled by sliding the shelf so that it is parallel to and in contact with the main panel and then folding the side panels inwardly to be parallel to and in contact with the main panel-shelf combination. The resulting flat package is the length and width of the main panel and is less than two inches thick.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a simple, lightweight portable podium.

Figure 1:
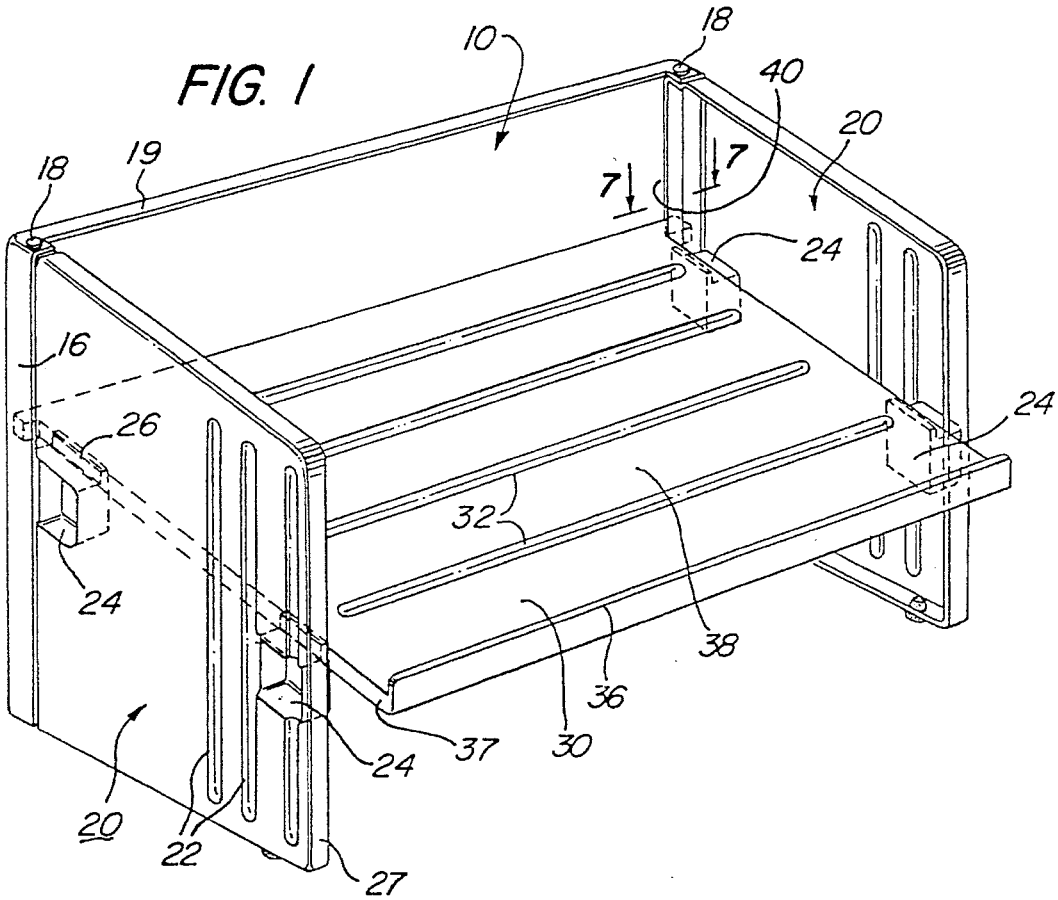
FIG. 1 is a perspective view of the assembled podium.

As can be seen in FIG. 1, the assembled podium is comprised of four parts: a main panel 10, two side panels 20, and a shelf 30. The parts of the podium are substantially flat. They can be made out of a number of different materials such as plastic, wood, aluminum or carbon fiber composites. Because one object of the present invention is to produce a lightweight podium, the preferred embodiment uses parts vacuum-formed from a plastic such as ABS. If the podium parts are constructed from a relatively thin plastic, increased rigidity can be provided by molding a lip 16, 27 around the edges of the parts and by molding ridges 22, 32 into the flat surfaces of the parts.

The assembled podium is able to stand on a supporting surface (usually a table or desk) because the main panel 10 and the two side panels 20 form, as seen from above, a "C"-shaped construction with the plane surface of the main panel 10 at right angles to the supporting surface and facing the audience. The two side panels 20 are attached to the main panel 10 so that their plane surfaces are perpendicular to that of the main panel 10. Thus, a protected region is formed surrounded by the main panel 10 on the front and the two side panels 20 on the side. The speaker stands behind this structure and provides a barrier that effectively closes off the protected region.

Figure 5:
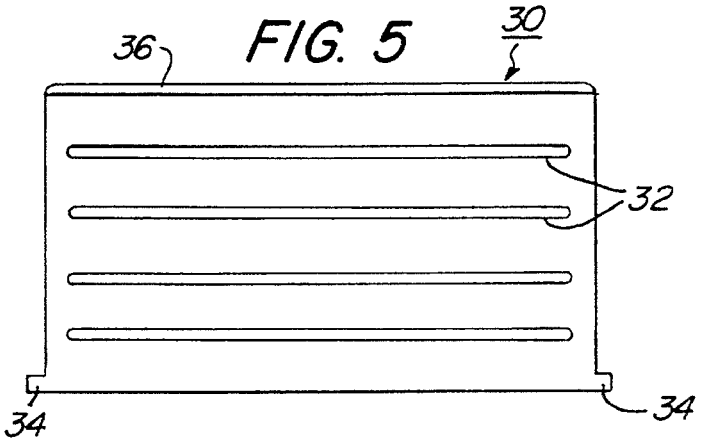
FIG. 5 is a view of the shelf showing the knobs that capture one end of the shelf.

The top of the assembled podium is not open. Rather, a shelf 30 rests on supports 24 attached to the side panels 20. These supports 24 are arranged so that the shelf 30 rests at an angle to the horizontal with its highest edge at the main panel 10 and its lowest edge nearest the speaker. Top corners of the shelf 30, those nearest to the main panel 10, bear knobs 34, as shown in FIG. 5. These knobs 34 are captured by channels 40 (described below) and thereby fix the top edge of the shelf 30 in place. The edge of the shelf 30 farthest from the main panel 10 bears a lip 36 to retain papers or books placed on the shelf 30. The angle of the shelf 30 from the horizontal is chosen to present the papers or books at an optimum angle for the speaker. As mentioned above, the main panel 10 and side panels 20 form a partial enclosure so that the papers are protected from stray air currents and are hidden from the view of the audience.

Figure 2:
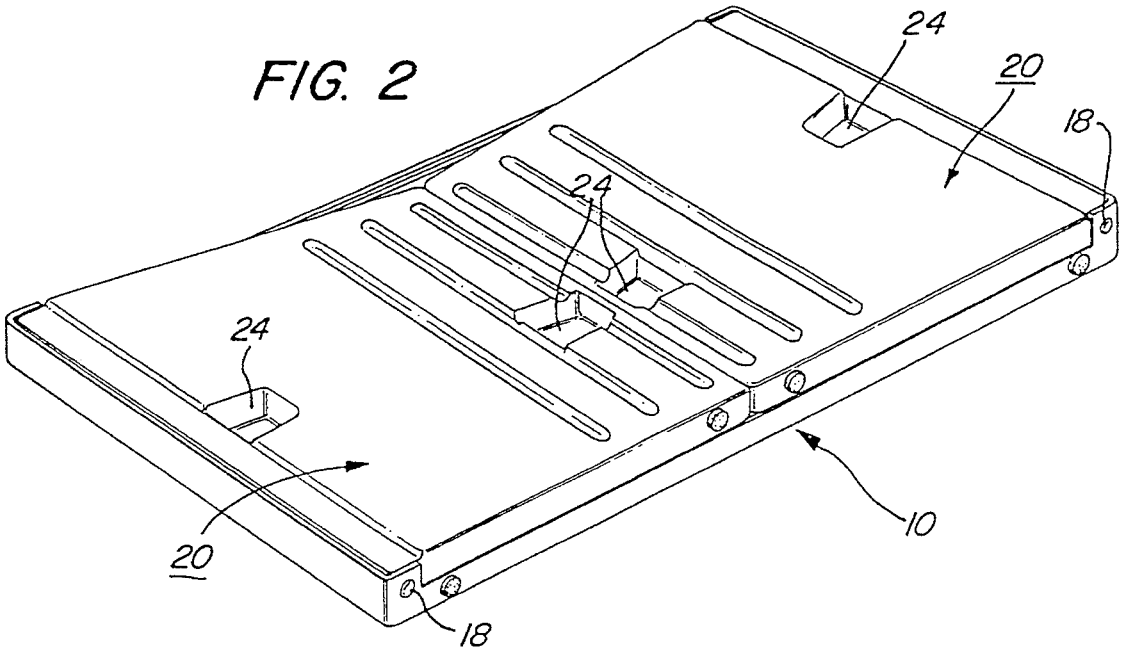
FIG. 2 is a perspective view of the collapsed podium.

Portability is an important object of the present invention. How the podium is assembled for use and disassembled for transport will now be explained. As shown in FIG. 2, the parts of the podium are all essentially flat and are sized to fit on top of one another so that the disassembled podium forms a flat, relatively thin package of a size to be readily carried and stowed in overhead compartments of commercial airliners. The shelf 30 is essentially the same size as the main panel 10 and, in the disassembled podium, rests flat upon the main panel 10o The two side panels 20 are approximately the same height as the main panel 10, but only about one-half the width. They are hingedly attached to the main panel 10 and, as shown in FIG. 2, are capable of being folded flat against the main panel/shelf combination.

Figure 3:
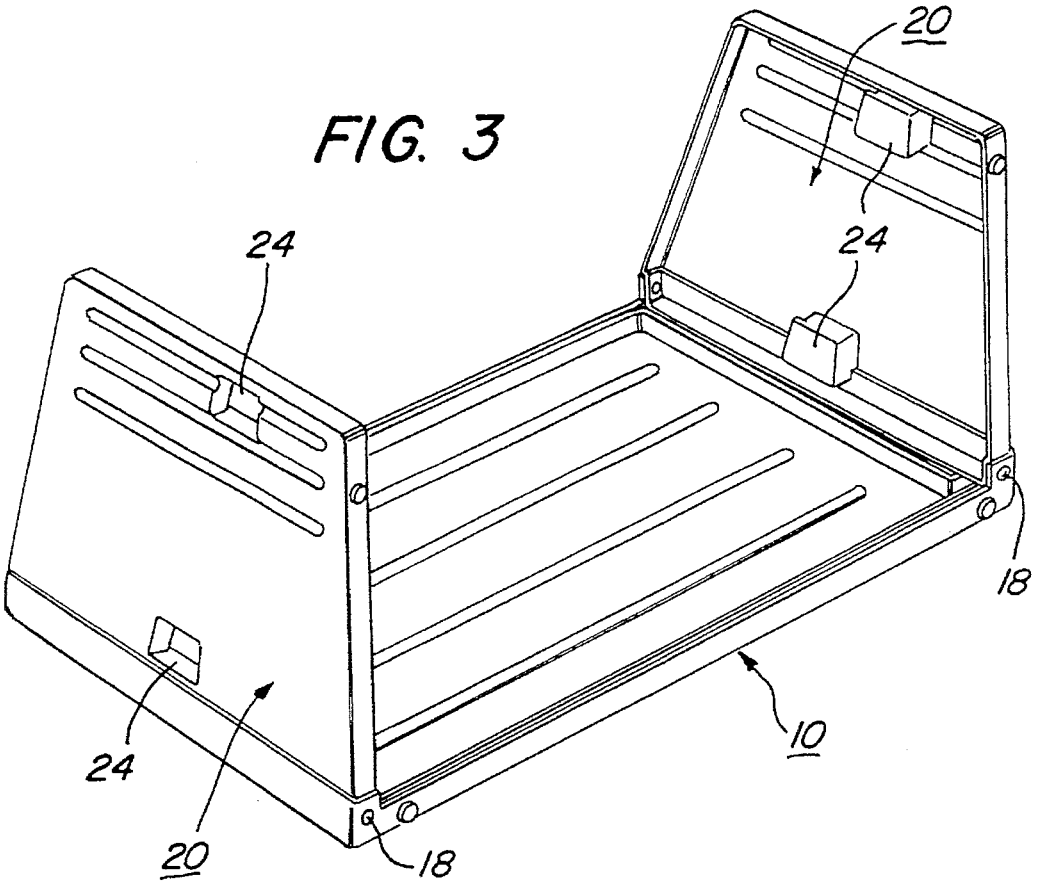
FIG. 3 is a perspective view of the partially assembled podium in which the side panels have been swung out to be at right angles to the main panel.
Figure 4:
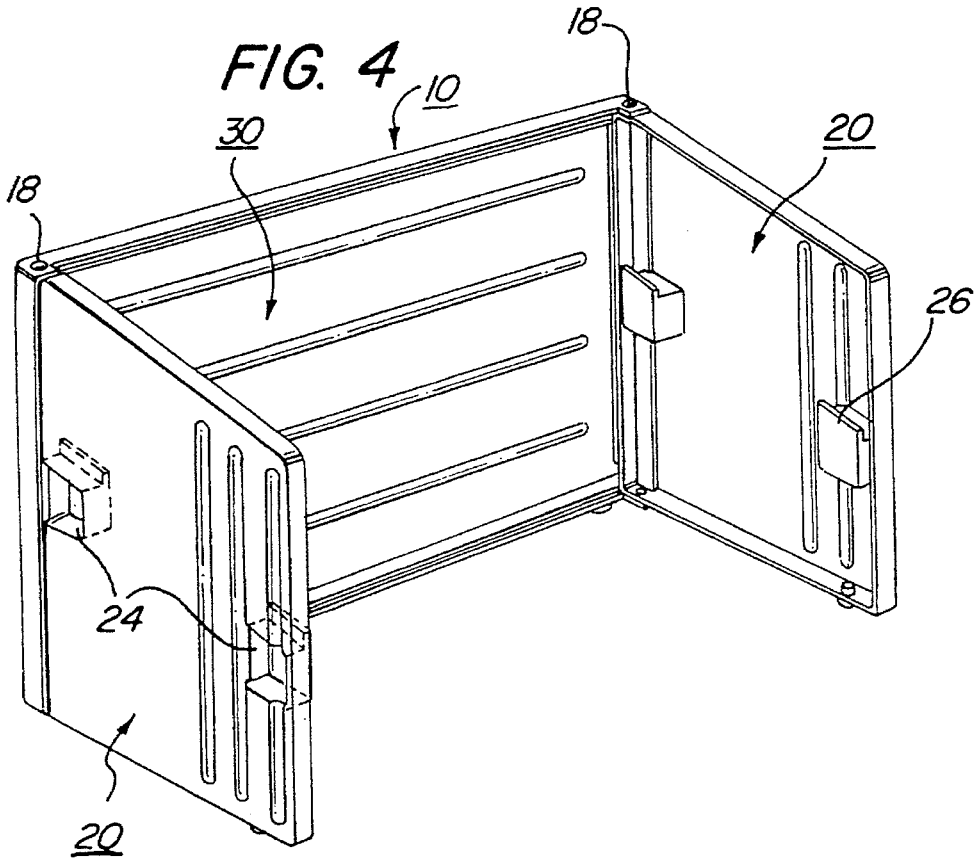
FIG. 4 is a perspective view of the partially assembled podium of FIG. 3 in which the unit has been flipped to place the bottom edges of the panels on the supporting surface.
Figure 7:
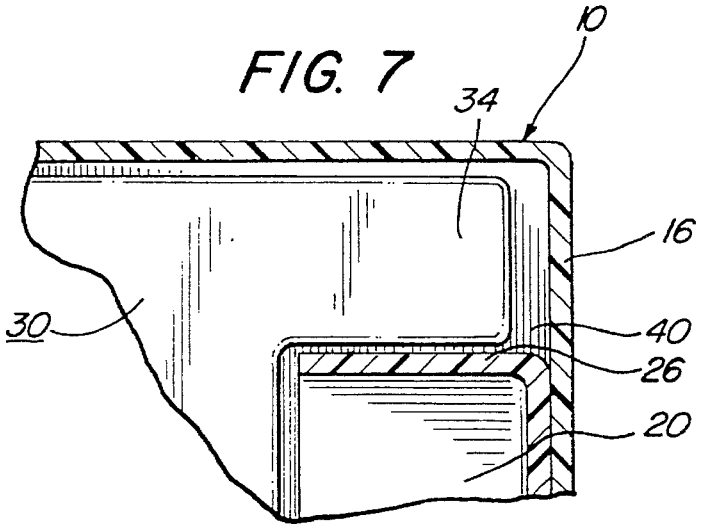
FIG. 7 is a view of the shelf retaining channel that is formed between a lip on a side panel and the main panel.

The first step in assembly is shown in FIG. 3. With the folded podium resting on the supporting surface, the hinged side panels 20 are swung up so that they are perpendicular to the main panel 10. Next (FIG. 4), the entire structure is rotated 90 degrees so that bottom edges of the main panel 10 and the side panels 20 rest on the supporting surface. At this point the shelf is still in its stowed position parallel to the main shelf and in contact with the main shelf. As shown in FIG. 5, two corners of the shelf 30 bear knobs 34. FIG. 7 shows that edges of the main panel 10 and the side panels 20 have molded lips 16, 27.

The side panels 20 are attached to the main panel 10 by pins 18 which penetrate the lips 16, 27 on top and bottom edges of the main panels 10 and the side panels 20. These pins 18 form a hinge which allows the side panels 20 to be swung out for assembly or swung in for disassembly. Regular hinges like those used on doors may be advantageously used particularly if the podium is constructed from wood or some material that is substantially thicker than vacuum-formed plastic. When the side panels 20 are swung away from the main panel 10, the lips 27 on the side panels 20 form channels 40 between the main panel 10 and the side panels 20. If the podium is constructed from thicker materials, the channels are formed directly by the edges of the side panels and lips are unnecessary. The knobs 34 of the shelf 30 are captured in these channels 40. Thus, the shelf 30 can readily move up and down in reference to the main panel 10 because the knobs 34 can easily slide in the channels 40. Furthermore, the shelf 30 can pivot in reference to the main panel 10 because the knobs 34 are free to either rotate or slide in the channels 40. However, because of the channels, the end of the shelf 30 that bears the knobs 34 always remains in close contact with the main shelf 10.

Figure 6:
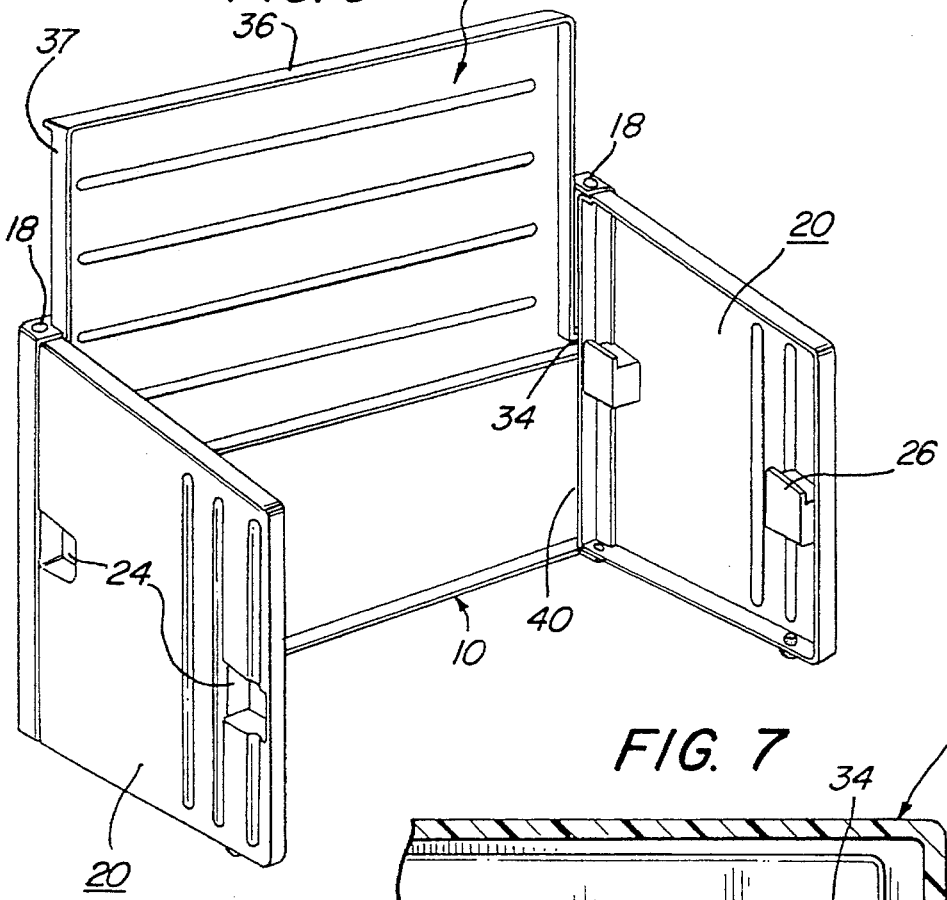
FIG. 6 is a perspective view showing how the shelf can be slid in a channel to complete assembly of the podium.

FIG. 6 shows the final steps in the assembly of the podium. An upper edge of the shelf 30 is grasped and pulled in an upward direction. The upper edge of the shelf 30 is constructed so that it has a round edged lip 36 pointing towards the main panel 10. As explained above, the shelf's knobs 34 readily slide in the channels 40, allowing the shelf 30 to be pulled up until the further sliding of the knobs 34 is blocked by an upper lip 19 of the main panel 10. At this point the upper edge with the lip 36 of the shelf is swung away from the plane of the main panel 10 towards the open side of the "C"-shaped structure (i.e., toward the person assembling the podium). During this process the shelf 30 pivots with the captured knobs 34 acting as axles.

The surface of the shelf 30 that was in contact with the surface of the main panel 10 now forms an upper surface 38 of the shelf 30 that will support papers or notes. The round-edged lip 36 that formerly faced the main panel 10 is now facing upward. Each of the side panels 20 bears two support structures 24. In the preferred embodiment the support structures 24 are integral parts of the side panels 20 and are produced in the same molding step that forms the side panels 20. These structures 24 support the underside of the shelf 30. The support structures 24 are arranged so that the final orientation of the shelf is not horizontal. Instead, the shelf 30 is supported at an optimal reading angle with the rounded lip 36 forming a barrier to keep notes from sliding off the shelf 30. The supports 24 each bear a tab 26 that interlocks with a lip 37 on the edge of the shelf 30 to further stabilize the podium. The shelf 30 is locked onto the side panels 20 so that the panels 20 cannot be moved without detaching the shelf 30.

The process of disassembly to collapse the podium for transport is the reverse of the above-described process. One grasps the lower end of the shelf 30 and lifts it so the shelf 30 pivots on the captured knobs 34. The shelf 30 is pivoted until it is essentially parallel to the main panel 10. Then the shelf 30 is slid in a downward direction so it ends up parallel to and in contact with the main panel 10. One then rotates the partially disassembled podium so the unit rests on the surface of the main panel 10 with the two side panels 20 oriented vertically. Then one pushes the upper edges of the side panels 20 toward the center of the main panel 10. The side panels 20 pivot on their hinges 18 and end up lying flat on the shelf 30 which, in turn, is lying on the main shelf 10. The resulting flat unit can be readily carried or can be put in a carrying case for ease of transportation.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A portable podium for supporting books and papers during activities of public speaking which can be readily assembled and disassembled, the podium comprising:

a main panel substantially rectangular in shape forming a front when the podium is assembled and having two side edges, a bottom edge, and a top edge;

two side panels, each side panel having two side edges, a bottom edge, and a top edge, each side panel about half as wide as the main panel, and sized to lie substantially co-planar on the main panel forming a flat package when the podium is disassembled;

a hinge attaching a side edge of a first side panel to a first side edge of the main panel;

a hinge attaching a side edge of a second side panel to a second side edge of the main panel;

a flat shelf sized to lie on the main panel when the podium is disassembled;

retention means for slidingly and pivotally retaining an edge of the shelf in proximity with the main panel; and support means attached to the side panels for supporting and engaging with the shelf when the podium is assembled, so that the disassembled podium can be assembled by swinging the side panels so that they are substantially perpendicular to the main panel, placing the bottom edges of the main panel and the side panels in contact with a horizontal support surface, sliding the shelf so that a retained edge of the shelf is above the support means and pivoting the shelf so that it engages the support means.

2. The portable podium of claim 1, wherein the retention means comprises projections from a first and from a second corner of the shelf, the projections being retained by channels that run along the side edges of the main panel.

3. The portable podium of claim 2, wherein the channels are formed between the main panel and the side edges of the side panels when the side panels are oriented perpendicular to the main panel.

4. The portable podium of claim 1, wherein the support means comprise members that project from the side panels, one near each side edge of the side panels, so that the shelf is supported near each of its corners.

5. The portable podium of claim 4, wherein the members that project from the side panel further bear tabs that engage a lip on an underside of the shelf.

6. The portable podium of claim 4, wherein the members that project from the side panel are hollow, being formed integrally with the side panel.

7. The portable podium of claim 1 wherein the hinges comprise pins that connect the side panels to the main panel.

8. A portable podium for supporting books and papers, wherein the podium can be readily assembled and disassembled the podium comprising:

a main panel forming a front when the podium is assembled;

two side panels, each side panel sized to lie substantially co-planar on the main panel forming a flat package when the podium is disassembled;

means for swingingly attaching the side panels to the main panel;

a substantially flat shelf to support the books and papers;

retention means for slidingly and pivotally retaining an edge of the shelf in proximity with the main panel; and support means attached to the side panels for supporting and engaging the shelf when the podium is assembled, so that the disassembled podium can be assembled by swinging the side panels so that they are substantially perpendicular to the main panel, sliding the shelf so that a retained edge is above the support means and pivoting the shelf so that it engages the support means.

9. The portable podium of claim 8, wherein the retention means comprises projections from a first and from a second corner of the shelf, the projections being retained by channels that run along the side edges of the main panel.

10. The portable podium of claim 9, wherein the channels comprise spaces between the main panel and the side edges of the side panels, the spaces formed when the side panels are oriented perpendicular to the main panel.

11. A portable podium for supporting books and papers during activities of public speaking, wherein the podium can be readily assembled and disassembled, the podium comprising:

a main panel, substantially rectangular in shape, forming a front when the podium is assembled and having two side edges, a bottom edge, and a top edge;

two side panels, each side panel having two side edges, a bottom edge, and a top edge, each side panel about half as wide as the main panel, and sized to lie substantially co-planar on the main panel forming a flat package when the podium is disassembled;

hinges for swingingly attaching a side edge of a first side panel to a first side edge of the main panel and for swingingly attaching a side edge of a second side panel to a second side edge of the main panel;

a flat shelf, of substantially the same dimensions as the main panel, sized to lie on the main panel when the podium is disassembled;

projections on a first and a second corner of the shelf, the projections captured in channels formed between the side panels and the main panel so that an edge of the shelf is slidingly and pivotally retained in proximity with the main panel; and support members integrally formed on the side panels, the support members contacting an underside of the shelf to support it at an angle with the front when the podium is assembled, with the support members bearing a tab which engages a lip on the underside of the shelf when the podium is assembled, so that the disassembled podium can be assembled by swinging the side panels so that they are substantially perpendicular to the main panel, placing the bottom edges of the main panel and the side panels in contact with a horizontal support surface, sliding the shelf so that a retained edge is above the support members and pivoting the shelf so that it engages the support members and rests at an angle to the front.

12. A portable podium which can be readily assembled and disassembled, the podium comprising:

a panel member forming a front when the podium is assembled;

a substantially flat shelf member lying substantially coplanar with the panel member when the podium is disassembled; and retention means for slidingly and pivotally retaining an edge of the shelf member in proximity with the panel member so that the shelf member can be disposed relative to the front for supporting books and papers when the podium is assembled.

13. A portable podium which can be readily assembled and disassembled, the podium comprising:

a panel member forming a substantially vertically-oriented front when the podium is assembled;

means for maintaining the panel member in a substantially vertical orientation when the podium is assembled;

a substantially flat shelf member lying substantially coplanar with the panel member when the podium is disassembled; and retention means for slidingly and pivotally retaining an edge of the shelf member in proximity with the panel member so that the shelf member can be disposed relative to the front for supporting books and papers when the podium is assembled.

14. The portable podium of claim 13, wherein the shelf member engages the vertical orientation means when the podium is assembled.

* * * * *